United States Patent [19]

Textoris et al.

[11] 4,041,881

[45] Aug. 16, 1977

[54] FURNITURE ARTICLE

[75] Inventors: Melvin A. Textoris, Struthers; William Wahl, Chagrin Falls, both of Ohio

[73] Assignee: GF Business Equipment, Inc., Youngstown, Ohio

[21] Appl. No.: 645,234

[22] Filed: Dec. 29, 1975

[51] Int. Cl.[2] ..... A47B 3/06

[52] U.S. Cl. ..... 108/159; 248/188.1; 248/188.9

[58] Field of Search ..... 108/158, 157, 159, 161; 248/188, 188.8, 188.9, 165, 188.1; 297/440

[56] References Cited

U.S. PATENT DOCUMENTS

| | | | |
|---|---|---|---|
| 2,669,495 | 2/1954 | Foote | 108/157 |
| 2,746,823 | 5/1956 | Sand | 248/165 |
| 3,106,295 | 10/1963 | Berlin | 108/159 |
| 3,254,362 | 6/1966 | Rasor et al. | 248/188.8 |
| 3,299,840 | 1/1967 | Schultz | 108/157 |
| 3,719,389 | 3/1973 | Burton et al. | 297/440 |

FOREIGN PATENT DOCUMENTS

| | | | |
|---|---|---|---|
| 1,057,130 | 3/1954 | France | 108/157 |
| 881,249 | 5/1953 | Germany | 108/159 |
| 320,703 | 4/1957 | Switzerland | 108/159 |

*Primary Examiner*—Roy D. Frazier
*Assistant Examiner*—Darrell Marquette
*Attorney, Agent, or Firm*—Emory L. Groff, Jr.

[57] ABSTRACT

A table includes a top connected to a support assembly comprising a plurality of inverted U-shaped integral components formed from elongated stock. A plurality of such components, equal in number to the number of table legs, are joined in series to provide a unitary support assembly of continuous bar stock with the juxtaposed ends of each pair of adjacent components being joined to form one leg of the table.

10 Claims, 4 Drawing Figures

FURNITURE ARTICLE

This invention relates generally to an article of furniture and more particularly to an improved table construction comprising a planar top in association with a unique support assembly.

By the present arrangement, an improved table construction is provided having a support assembly formed of elongated or bar stock of minimal diameter and which includes a plurality of similarly constructed components which are readily assembled at the point of use by the user without the necessity of any special tools or skilled labor. In the knock-down state the components of the support assembly occupy little more height than the thickness of the table top itself, yet when quickly assembled to one another and the table top itself, the resultant furniture article possesses remarkable lateral stability in all directions, notwithstanding the minimal thickness of the stock forming the numerous members of the support assembly.

The present construction also lends itself to ready stacking of a plurality of the thus constructed tables without damage to any of the table top upper surfaces while also permitting of the stacking of a significant number of such tables in a relatively small vertical space. Many tables require the provision of side rails comprising separate elongated members attached to the top undersurface and extending adjacent the top edge between each pair of adjacent table legs. These side rails serve the dual function of providing reinforcement to the table top and most importantly provide means for the attachment and bracing of each leg of the table. In the instant table a support assembly is provided comprising a plurality of inverted U-shaped components which when assembled in series form a plurality of U-shaped legs and results in a unitary support assembly of continuous, uninterrupted bar stock with portions of the stock serving as side rails and integral with the legs.

Accordingly, one of the primary objects of the present invention is to provide an improved furniture article including a planar top and an attached unitary support assembly comprising a plurality of similarly constructed members formed from relatively small bar stock and joined in series.

A further object of the present invention is to provide an improved furniture article including a planar top and a support assembly of bar stock comprising a plurality of inverted U-shaped components with each support component providing one-half the structure of two legs of the furniture article and an intermediate side rail attachable to the top.

Still another object of the present invention is to provide an improved furniture article having a support assembly connected to a top and comprising a plurality of support components constructed of bar stock and assembled in adjacent series relationship to provide a single continuous bar construction throughout the periphery of the furniture article and forming a plurality of U-shaped legs.

With these and other objects in view which will more readily appear as the nature of the invention is better understood, the present invention consists in the construction, combination and arrangement of parts hereinafter more fully described, illustrated and claimed.

A practical and preferred embodiment of the present invention is shown in the accompanying drawing, in which.

Similar reference characters designate corresponding parts throughout the several figures of the drawing.

Figure 1:
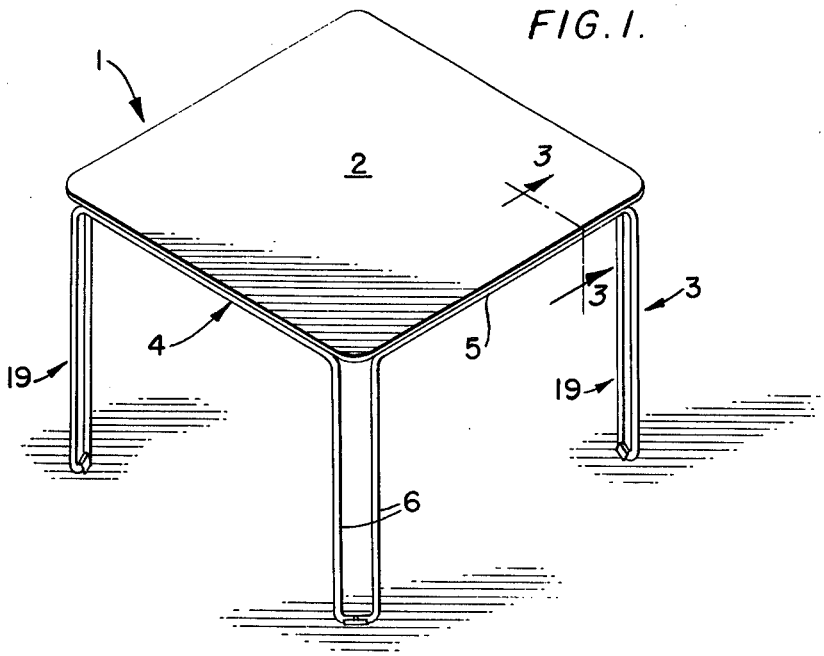
FIG. 1 is a top perspective view of a furniture article according to the present invention.

Referring now to the drawing, particularly FIG. 1, the present invention will be seen to be illustrated in association with a table, generally designated 1, and includes a planar top attached to a support assembly generally designated 3. As will be more readily appreciated after consideration of the description hereinafter, the unique construction of the elements comprising the support assembly 3 may be combined with a table top 2 having various cnfigurations other than that as represented by the square configuration in this figure of the drawing.

The support assembly 3 comprises a plurality of integral support components 4, each of which is generally of an inverted U-shaped construction including a horizontal top member 5 having a vertical leg member 6 depending from each end thereof. It will be understood that all members forming the support components 4 are of elongated or bar stock and preferably comprise a solid or bar stock of relatively minimal diameter. The lower distal portion of each vertical leg member 6 terminates in a short offset foot member 7 disposed in a horizontal plane and angularly offset with respect to the longitudinal axis of the horizontal top member 5. In the case of a table having a top 2 of quadrangular configuration, it will be seen that each foot member 7 will be disposed at an angle of 45° from the axis of its respective horizontal top member 5 for reasons which will become obvious hereinafter.

Figure 2:
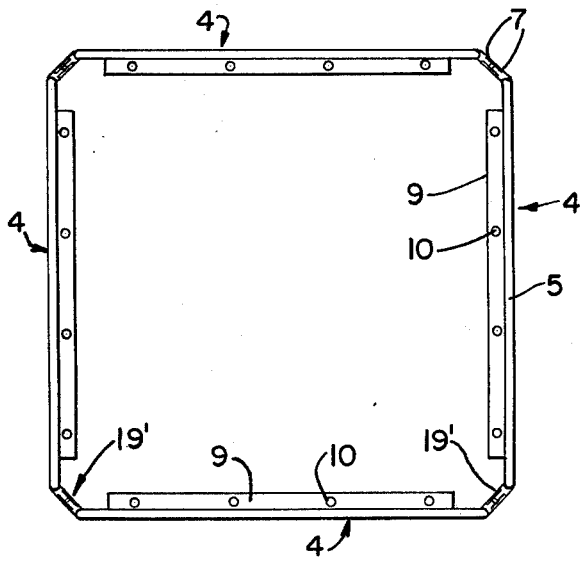
FIG. 2 is a top plan view of the support assembly shown in the furniture article illustrated in FIG. 1.
Figure 3:
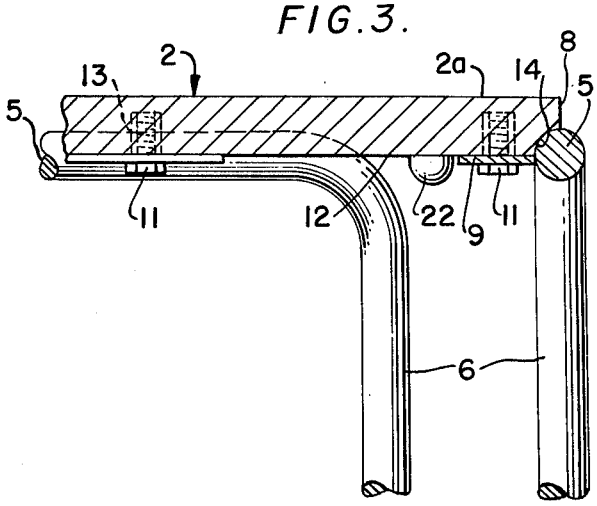
FIG. 3 is an enlarged vertical sectional view taken along the line 3—3 of FIG. 1.

Means are provided to permit the ready attachment of each support component 4 to the table top 2 with the horizontal top member 5 serving as a side rail adjacent the top edge 8. This means is most clearly shown in FIGS. 2 and 3 of the drawing wherein it will be seen that a horizontal mounting flange 9 is welded or otherwise suitably attached to one side of the top member 5 and defines an axial length just short of the overall length of the top member. This mounting flange 9 is provided with a plurality of holes 10 for the reception of suitable threaded fasteners 11 adapted to be secured to the lower surface 12 of the table top 2, and appropriate socket members 13 may be pre-located within the lower body of the table top 2 for cooperation with each of the fasteners 11. For maximum strength and utility, the mounting flange 9 is preferably attached to the midpoint of one side of the horizontal top member 5 of the support component 4 as shown in FIG. 3 of the drawing and to provide a smoother finish without any dirt-accumulating cavities adjacent the top edge 8. The edge 8 and lower surface 12 of the table top 2 may be provided with the relief area 14 mating with the configuration of the bar stock of the support component 4, which arrangement obviously further enhances the rigidity of the attachment of the support assembly 3 to the table top 2.

Figure 4:
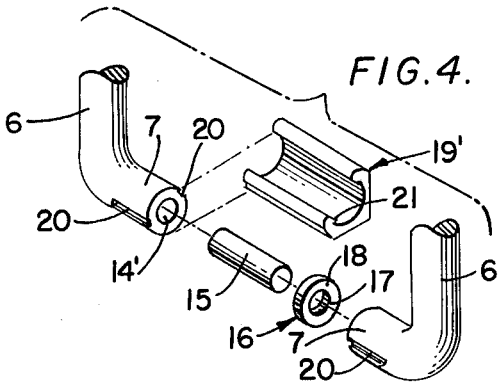
FIG. 4 is an enlarged fragmentary exploded perspective view illustrating the construction of the bottom of each leg of the furniture article of FIG. 1.

Preferably the entire support assembly 3 is pre-assembled prior to its attachment, as a unitary member, to the lower surface 12 of the table top 2, particularly when the assemblies are being done by one person. Accordingly, the joining of one support component 4 in series to its adjacent support component 4 will now be discussed. As shown in FIG. 4 of the drawing, the bar stock of each foot member 7 is provided with an axial bore 14' and into which is force-fitted approximately one-half the length of a roll pin 15. Prior to the press-fitting of the opposite or free end of the roll pin 15 into the bore of the adjacent foot member 7, a flat washer or spacer 16, preferably of plastic material, is slipped over the exposed end of the roll pin 15. Thus, the bore 17 of the washer 16 should provide a close sliding it with the periphery of the roll pin 15 while the periphery 18 of the washer 16 defines a diameter no greater than that of the bar stock of the foot member 7. When each two adjacent opposed foot members 7 are joined by a single roll pin 15 provided the flat washer 16, a single leg, generally designated 19, will be thus formed as shown in FIGS. 1 and 2 of the drawing. With all of the support components 4 joined in series as shown in FIGS. 1 and 2, it will be seen that a complete support assembly 3 is thus provided comprising a plurality of inverted U-shaped components 4 resulting in a plurality of U-shaped legs 19 resulting, in effect, in a continuous or uninterrupted bar extending completely about the periphery of the furniture article to provide alternate side rails or top members 5 integral with the legs 19 and wherein each said leg is angularly disposed with respect to and fully and solely supported by the two adjacent integral top members.

To prevent marring of both the bottom of each leg 19 as well as the surface of the floor on which the table rests, an appropriate glide 19' may be attached to the lower portion of each leg by the arrangement shown most clearly in FIG. 4 of the drawing, wherein it will be seen that a pair of diametrically opposed attaching grooves 20—20 are provided in the outer periphery of each foot member 7 for the reception, in a snap-fitting manner, of the prongs 21—21 of the plastic glide 19'. Such glide construction per se is shown in detail in U.S. Pat. No. 3,254,362 issued June 7, 1966 to the same assignee as the instant invention. Additionally, it will be apparent that suitable leveling means (not shown) may be associated with the glide 19' whenever desired.

As mentioned earlier, the support assembly 3 of the table 1 lends itself to ready stacking of a plurality of such tables one upon another. This is accomplished merely angularly offsetting each succeeding table to allow the legs 19 of one table to hang clear of the top edge 8 and legs of the next lower table. Damage to the upper surface 2*a* of supporting table tops 2 is precluded by the provision of the resilient bumpers 12 on the lower surface 12 of each top 2. A single bumper 22 intermediately disposed adjacent each side of the top inwardly of the mounting flange 9 will safely support the table with the heads of the fasteners 11 and the top members 5 above the next lower table top. It will be apparent that the lower portion of the bumpers 22 should extend to a plane lower than the bottom of the top members 5.

The concept of the present invention may be carried out in combination with a table top of various configurations other than the square shape as shown in FIG. 1. With any polygonal shape there will still be one support component 4 for each side of the table top and in the case of a curved or circular top there will be at least three support components having the same leg construction as illustrated, but with the top members being curved similar to the table top periphery. In the latter instance, instead of a continuous mounting flange, a plurality of spaced-apart mounting tabs would serve to permit attachment of the support assembly to the table top.

We claim:

1. A table including, a planar top, a support assembly extending beneath the lower surface of said top comprising an endless elongated stock defining a plurality of U-shaped legs each said leg including a pair of vertical leg members, a horizontal top member joining one said member of each said leg to one said member of an adjacent said leg whereby, each said horizontal top member and said leg member joined to its end defining a support component having an inverted U-shaped configuration, said top having a vertical peripheral edge extending from said planar top to a point short of said top lower surface, an arcuate relief surface in said top joining said vertical peripheral edge and said lower surface and having a configuration mating with a segment of the periphery of said horizontal top member, and means on each said horizontal top member engaging the lower surface of said table top to permit attachment of said support assembly to said table top

2. A table according to claim 1 wherein, said support assembly elongated stock is cylindrical in cross section.

3. A table according to claim 1 wherein, said attachment means includes a flange extending from the periphery of said horizontal top member and fasteners extending through said flange into said table top lower surface.

4. A table according to claim 1 wherein, each said support component is of integral construction.

5. A table according to claim 1 wherein, said top is of polygonal configuration and said table includes one said support component for each side of said polygonal top.

6. A table according to claim 1 including, a plurality of bumpers on the lower surface of said table top each disposed intermediate a pair of said U-shaped legs and extending below the horizontal plane of said horizontal top members and said attachment means.

7. A table according to claim 1 wherein, the bight of said U-shaped legs includes a foot member extending horizontally from the lower end of each said vertical leg member and means rigidly connecting the opposed ends of each pair of said foot members.

8. A table according to claim 7 wherein, said table top is rectangular and each said foot member is offset horizontally 45° from the longitudinal axis of its respective horizontal top member.

9. A table according to claim 7 wherein, each said foot member is provided with a bore, and said connecting means includes a pin fitted into each pair of opposed foot member bores.

10. A table according to claim 7 including, a glide fitted over at least a portion of the undersurface of each pair of connected foot members.

* * * * *